United States Patent [19]

Brown et al.

[11] Patent Number: 4,723,699

[45] Date of Patent: Feb. 9, 1988

[54] ADJUSTABLE CLASP LOCK

[75] Inventors: William M. Brown, Darien, Conn.; Guelfo A. Manizza, Blauvelt, N.Y.

[73] Assignee: Federal Paper Board Co., Inc., Montvale, N.J.

[21] Appl. No.: 863,944

[22] Filed: May 16, 1986

[51] Int. Cl.[4] ..... B65D 5/42; B65D 71/00

[52] U.S. Cl. ..... 229/40; 206/140; 206/147; 206/434; 229/185

[58] Field of Search ..... 206/140, 427, 434, 147; 229/40, 48 R, 185, 45 R, 87 R, 89–92

[56] References Cited

U.S. PATENT DOCUMENTS

| | | | |
|---|---|---|---|
| 3,395,791 | 8/1968 | Graser | 229/40 |
| 3,478,951 | 11/1969 | Graser | 229/40 |
| 3,674,137 | 7/1972 | Graser | 229/40 |
| 4,433,806 | 2/1984 | Ganz et al. | 229/40 |
| 4,433,807 | 2/1984 | Ganz | 229/40 |
| 4,437,606 | 3/1984 | Graser | 206/140 |
| 4,476,977 | 10/1984 | Manizza | 206/434 |
| 4,498,618 | 2/1985 | Sutherland | 206/434 |
| 4,526,316 | 7/1985 | Sutherland | 206/140 |
| 4,600,140 | 7/1986 | Milliens | 206/140 |

*Primary Examiner*—Jimmy G. Foster
*Attorney, Agent, or Firm*—Charles E. Brown

[57] ABSTRACT

This relates to a clasp lock for interlocking two overlapping closure panels of a carton. The clasp lock is made adjustable to compensate for different sizes of articles being packaged in the same carton. In order to effect the adjustment of the lock between the closure panels, the primary locking tab is of a stepped height and the closure panel carrying the primary locking shoulders is cut so that the primary locking shoulders are also stepped with respect to the free edge of the associated closure panel. In the interlocking of the closure panel portions, the primary locking tab will automatically engage the proper primary locking shoulder in accordance with the objects which are being packaged within the carton.

12 Claims, 10 Drawing Figures

ADJUSTABLE CLASP LOCK

This invention relates to new and useful improvements in clasp locks and more particularly to an adjustable clasp lock wherein the effective width of closure panels of a carton may be varied so as to compensate for variation in sizes of containers to be packaged within such a carton.

Clasp locks per se are known. Adjustable clasp locks are also known, but the secondary lock is separate and distinct from the primary lock.

In accordance with this invention, there is provided a simple adjustable clasp lock which utilizes a minimum of paperboard in order to form the overlapping interlock between the closure panels of a carton. The outer closure panel is provided with a hinged flap adjacent the free edge thereof and the hinged flap has formed integrally therewith a primary locking tab which is struck from the material of the outer closure panel. The primary locking tab has a stepped edge so as to provide two separate and transversely spaced primary locking surfaces. Further, the cut line which defines the stepped edge of the primary locking tab also defines an opening for receiving a secondary locking tab.

The inner closure panel is provided with a clasp which includes a hinged flap having end surfaces of a stepped relationship so as to define in the inner closure panel two adjacent primary locking shoulders which are spaced differently from the free edge of the inner closure panel. A selected one of the primary locking shoulders may be engaged by the primary locking tab so as to determine the tightness of the carton.

The clasp will also include a secondary locking tab carried by the flap which is part of the inner closure panel with the secondary locking tab being movable through the outer closure panel and back into the opening formed when the secondary locking tab is struck from the inner closure panel. Thus no separate shoulder means are required for the secondary locking tab and this permits the flap carrying the primary locking tab to be of a minimum width and with the secondary locking tab being disposed closely adjacent the free edge of the inner panel wherein a minimum of board is required for the interlock of the two closure panels.

With the above and other objects in view that will hereinafter appear, the nature of the invention will be more clearly understood by reference to the following detailed description, the appended claims and the several views illustrated in the accompanying drawings.

Figure 1:
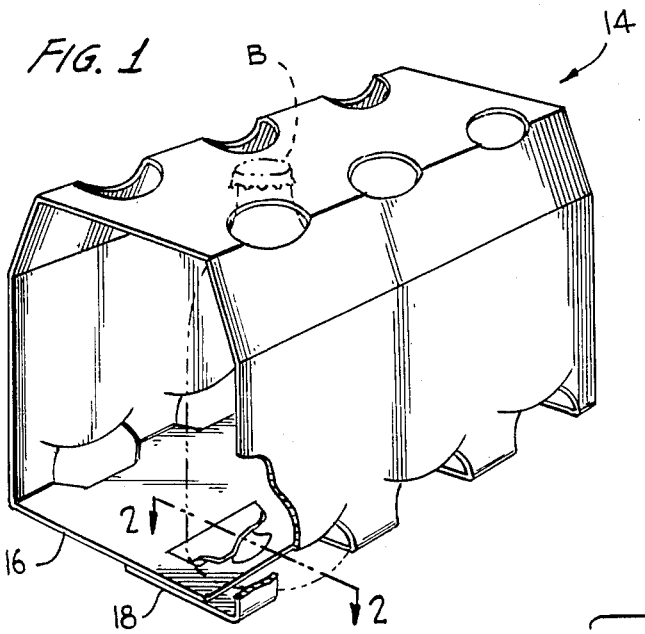
FIG. 1 is a top perspective view of a carton utilizing the invention.
Figure 2:
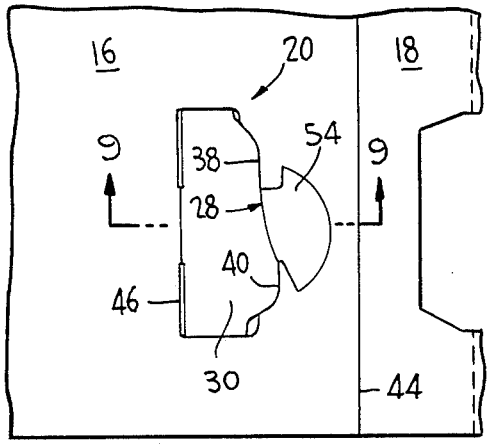
FIG. 2 is an enlarged fragmentary plan view showing two closure panels of the carton of FIG. 1 locked together by the adjustable clasp lock.

Referring now to the drawings in detail, it will be seen that there is illustrated in FIG. 1 a carton 14 forming in conjunction with bottles B a package. The carton 14 is formed of paperboard and has at the bottom thereof two closure panels, an inner closure panel 16 and an outer closure panel 18. The closure panels 16, 18 are locked together utilizing an adjustable clasp lock formed in accordance with this invention, the adjustable clasp lock being generally identified by the numeral 20.

At this time it is pointed out that generally speaking, there will be a number of clasp locks equal to the number of bottles B within the carton. Further, it is pointed out at this time that the clasp lock is made adjustable so as to permit the carton 14 to accommodate bottles of different sizes. It will be readily understood that the bottles not only may be of different sizes, but the bottles may be oval in cross section so as to either occupy a narrow space or a wide space.

Figure 3:
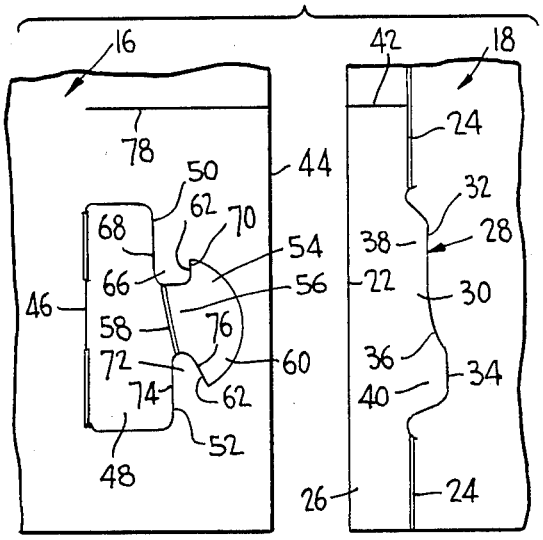
FIG. 3 is a fragmentary plan view of the two closure panels, but separated so as to show the details of the locking components thereof.

Referring now to FIG. 3, it will be seen that the outer closure panel 18 has a free edge 22 and extending parallel to the free edge 22 is an interrupted fold line 24 which defines a first flap 26. The closure panel 18 is also provided with a cut line 28 which interrupts the fold line 24 and which defines primary locking tab 30. It will be seen that each primary locking tab 30 is integrally formed with its associated first flap 26.

The primary locking tab 30 is defined remote from the flap 26 by two offset straight line portions 32 and 34 of the cut line 28 joined by an arcuate cut line portion 36. It will be seen that the cut line portions 32, 34 are disposed at different distances from the free edge 22 so as to define primary locking surfaces 38, 40 of different heights.

It is also to be noted that, if desired, instead of there being one continuous first flap 26 along the free edge 22 of the outer closure panel 18, the falp 26 may be divided into a plurality of parts by suitable cut lines 42.

A review of FIG. 3 will also show that the clasp 20 is formed by a combination of cut lines and a fold line. The inner closure panel 16 has a free edge 44 and remote from this free edge, the closure panel 16 is provided with a transversely extending fold line 46. Associated with the fold line 46 is a plurality of cut lines which are continuous. Portions of the cut lines define a second flap 48 which is connected to the remainder of the closure panel 16 along the fold line 46. The cut line portions are so arranged wherein the flap 48, remote from the fold line 46, is defined by offset cut lines 50, 52 with the flap 48 at one end thereof being of a lesser width than at the opposite end, the portion of the flap 48 adjacent the cut line 50 being narrower than the portion of the flap 48 adjacent the cut line 52.

The second flap 48 carries a secondary locking tab 54 which is disposed adjacent to the second free edge 44 and which has an intermediate neck portion 56 integrally connected to the second flap 48 between the cut lines 50, 51. The neck portion 56 is connected to the second flap 48 along a sloping fold line 58.

The secondary locking tab 54 has a tab head 60 which is preferably centralized with respect to the neck portion 56. The secondary locking tab head 60 being arranged symmetrical with respect to the neck portion 56, defines two locking ears 62. It is to be appreciated, however, that the head 60 could be offset with respect to the neck portion 56 and that there be but a single locking ear.

It will be seen that the cut line portions including the cut line portion 50, define between the second flap 48 and the secondary locking tab 54, a projection 66 which at one side thereof defines a primary locking shoulder 68 and at the opposite side thereof a secondary locking shoulder 70. In a like manner, the cut lines including the cut line portion 52, define between the second flap 48 and the secondary locking tab 54, a projection 72 which has on one side thereof a primary locking shoulder and at the opposite side thereof a secondary locking shoulder 76.

It is also pointed out at this time that in order to facilitate the flexing of individual portions of the inner closure panel 16, the free edge portion of that closure panel may be divided into a plurality of segments by cut lines 78.

OPERATION

Figure 4:
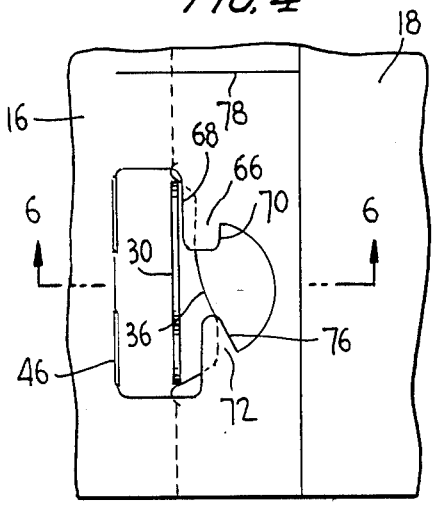
FIG. 4 is a fragmentary plan view similar to FIG. 2 but showing the initial engagement of the primary locking tab with one of the primary locking shoulders to provide a close arrangement.
Figure 6:
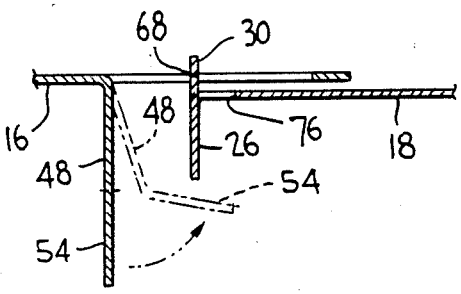
FIG. 6 is a vertical sectional view taken generally along the line 6—6 of FIG. 4 and shows more specifically the relationship of the locking element with the primary locking tab being initially engaged.

In use, the bottles B are traveling in an arrangement in accordance with the number of bottles which are being packaged within the carton 14. The carton blank is then engaged over the neck of the bottles and folded down around the bottles. Finally, the closure panels 16 and 18 are folded beneath the bottles. As is shown in FIGS. 4 and 6, with the clasp 20 struck down from the closure panel 16 and the first flap 26 folded down relative to the closure panel 18, the primary locking tab 30 is passed through the opening in the closure panel 16 formed by the striking down of the clasp 20. When the bottles B are of the smaller provided for size, the primary locking tab 30 engages behind the primary locking shoulder 68 as is clearly shown in FIG. 4. The primary locking shoulder 68 is engaged by the primary locking surface 38.

Figure 7:
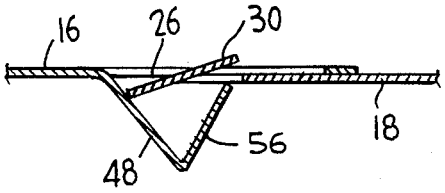
FIG. 7 is a vertical sectional view similar to FIG. 6 but with the primary locking tab fully in place.
Figure 8:
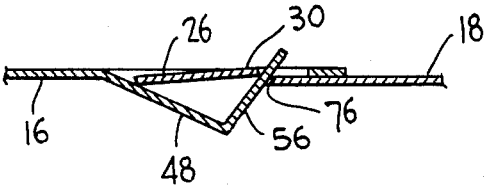
FIG. 8 is a vertical sectional view similar to FIG. 6 and shows the secondary locking tab started into engagement.

As the forming of the lock between the closure panels continues, as is shown in FIG. 7, the first flap 26 is folded up against the underside of the closure panel 16 with the locking tab 30 being fully engaged.

Figure 9:
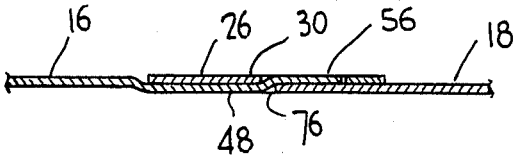
FIG. 9 is a vertical sectional view taken along the line 9—9 of FIG. 2 and shows the secondary locking tab in place.

At this time with the secondary locking tab 56 folded relative to the second flap 48 along the fold line 58, the secondary locking tab is started through the outer closure panel 18 through the opening defined by the cut line 28 and back into the opening from which the primary locking tab 54 was struck. Finally, in the fully engaged position of the clasp lock, as is shown in FIG. 9, the head 60 is seated back into the inner closure panel 16 and interlocked therewith.

Figure 5:
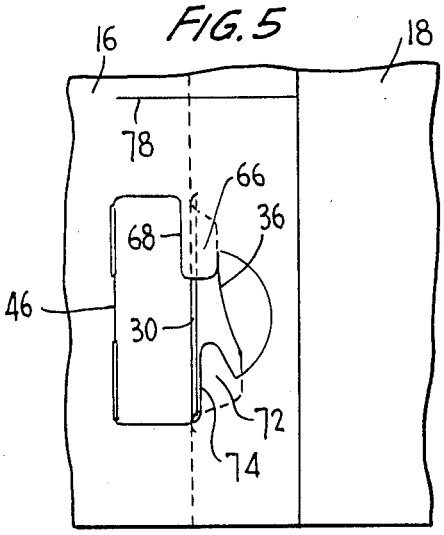
FIG. 5 is a view similar to FIG. 4 but showing the primary locking tab engaging a second of the primary locking shoulders to provide for a wide relationship.

Reference is now made to FIG. 5 wherein it will be seen that when the bottles B are of a larger size, when the primary locking tab 30 is passed up into the opening in the inner closure panel 16, the primary locking tab 30 will not engage the primary locking shoulder 68, but will engage the primary locking shoulder 74. The lock will then be completed in the manner described above with respect to FIGS. 6–9.

At this time it is pointed out that the narrower portion of the primary locking tab 30 will be longitudinally aligned with the primary locking shoulder 68 which is the furthest from the free edge 44, while the widest portion of the primary locking tab 30 will be longitudinally aligned with the primary locking shoulder 74.

Figure 10:
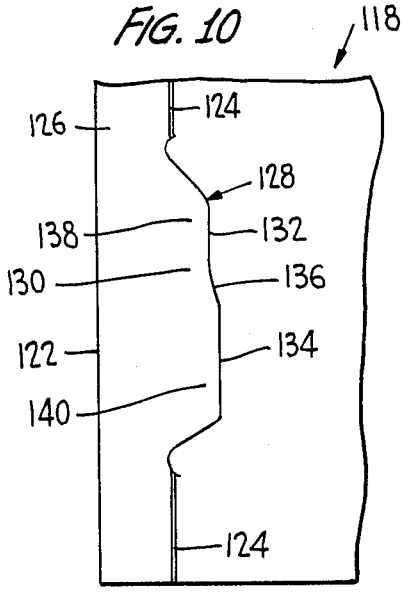
FIG. 10 is a plan view of the outer closure panel showing a slightly modified form of primary locking tab.

Reference is now made to FIG. 10 wherein there is illustrated a closure panel 118 having formed therein a modified primary locking tab 130. Like the closure panel 18, the closure panel 118 has a free edge 122. The closure panel 118 has formed therein parallel to the free edge 122 an interrupted fold line 124 which sets off adjacent the free edge of the closure panel 18 a hinged first flap 126.

The primary locking tab 130 is integrally formed with the first flap 126 for hinging therewith and is defined by a cut line generally identified by the numeral 128. The cut line 128 dfines the edge of the primary locking tab 130 remote from the terminal edge 122 with the edge of the primary locking tab 130 including a straight line portion 132 which is disposed slightly closer to the free edge 122 than a straight edge 134 disposed at the opposite end of the primary locking tab 130. The two straight portions 132, 134 are connected by an arcuate portion 136. The configuration of the cut line 128 is such so as to define a primary locking surface 138 longitudinally aligned with the straight cut 132 and a primary locking surface 140 which is longitudinally aligned with the straight cut 134.

It will be seen that the primary locking tab 130 differs from the primary locking tab 30 in two manners. First of all, the overall height of the primary locking tab 130 is less than that of the primary locking tab 130. Further, the difference in heights of the two primary locking surfaces is greater in the primary locking tab 30 than in the primary locking tab 130.

The primary locking tab 30 is utilized where there is no packaged article overlying the area of the primary locking shoulders 68, 74. When the articles being packaged are bottles, there is sufficient clearance. However, when the articles being packaged are flat bottom boxes, for example, then there is no space for the primary locking tabs to enter through the closure panel 16. It will thus be necessary to utilize the reduced height of the primary locking tab 130.

Although only two preferred embodiments of the adjustable clasp lock have been illustrated and described herein, it is to be understood that further modifications may be made in the clasp lock without departing from the spirit and scope of the invention.

We claim:

1. An adjustable clasp lock for closure panels of cartons and the like, said closure panels including an inner panel and an outer panel, said outer panel having a first free edge, a combination of a first cut line and first fold lines adjacent said first free edge defining a hinged first flap extending along said first free edge, said first cut line defining in projecting relation on said first flap a primary locking tab movable with said first flap and projecting away from said first free edge, said inner panel having a second free edge, a clasp formed in said inner panel by a combination of at least one second cut line and at least one second fold line, said clasp including a second flap hingedly connected to said inner panel along said second fold line with said second flap projecting towards said second free edge, said second cut line defining on said second flap a secondary locking tab joined to said second flap by a narrow neck portion with said secondary locking tab having on at least one side of said neck portion a locking ear, said second cut line defining edges of said second flap remote from said second fold line and also defining on said inner panel primary locking shoulders facing away from said second free edge for selective engagement by said primary locking tab, said primary locking tab having primary locking surfaces, said primary locking shoulders being spaced different distances from said second free edge for varying the effective combined width of said closure panels.

2. An adjustable clasp lock according to claim 1 wherein in the interlocking of said closure panels said first cut line defines an opening in said outer panel for the passage of said secondary locking tab.

3. An adjustable clasp lock according to claim 1 wherein in the interlocking of said closure panels said first cut line defines an opening in said outer panel for the passage of said secondary locking tab, and said secondary locking tab is returnable into an opening in said inner panel from which said secondary locking tab is formed for engagement of said locking ear with said inner panel.

4. An adjustable clasp lock according to claim 1 wherein said second flap on opposite sides of said neck portion is of different widths normal to said second fold line.

5. An adjustable clasp lock according to claim 1 wherein said second flap on opposite sides of said neck portion is of different widths normal to said second fold line, and said neck portion being joined to said second flap along a transversely sloping fold line extending between said different widths of said second flap.

6. An adjustable clasp lock according to claim 1 wherein said primary locking surfaces are transversely spaced and longitudinally aligned with respective ones of said primary locking shoulders.

7. An adjustable clasp lock according to claim 1 wherein said primary locking surfaces are defined by a free edge of said primary locking tab disposed remote from said first flap with said primary locking tab free edge having transversely spaced portions of different spacing from said first flap whereby said primary locking surfaces are of different heights.

8. An adjustable clasp lock according to claim 7 wherein the higher of said primary locking surfaces is aligned with said primary locking shoulder positioned closer to said second free edge, and the lower of said primary locking surfaces is aligned with said primary locking shoulder positioned further from said second free edge.

9. An adjustable clasp lock according to claim 7 wherein said primary locking tab free edge between said transversely spaced portions is arcuate and convex towards said first free edge.

10. An adjustable clasp lock according to claim 9 wherein said transversely spaced portions are substantially flat and parallel to one another.

11. An adjustable clasp lock according to claim 7 wherein the difference in heights of said primary locking surfaces is pronounced.

12. An adjustable clasp lock according to claim 7 wherein the difference in heights of said primary locking surfaces is minimal.

* * * * *